US006162389A

United States Patent [19]

Hase et al.

[11] Patent Number: 6,162,389

[45] Date of Patent: Dec. 19, 2000

[54] HIGH-STRENGTH AND HIGH-TOUGHNESS NON HEAT-TREATED STEEL HAVING EXCELLENT MACHINABILITY

[75] Inventors: Kazukuni Hase; Takashi Iwamoto; Yasuhiro Omori; Toshiyuki Hoshino; Tohru Hayashi; Keniti Amano; Toshio Fujita, all of Kurashiki, Japan

[73] Assignee: Kawasaki Steel Corporation, Kobe, Japan

[21] Appl. No.: 09/077,347

[22] PCT Filed: Sep. 24, 1997

[86] PCT No.: PCT/JP97/03380

§ 371 Date: May 26, 1998

§ 102(e) Date: May 26, 1998

[87] PCT Pub. No.: WO98/13529

PCT Pub. Date: Apr. 2, 1998

[30] Foreign Application Priority Data

| | | | |
|---|---|---|---|
| Sep. 27, 1996 | [JP] | Japan | 8-256182 |
| Sep. 27, 1996 | [JP] | Japan | 8-256183 |
| Sep. 18, 1997 | [JP] | Japan | 9-253657 |

[51] Int. Cl.[7] ..... C22C 38/08; C22C 38/60; C22C 38/16

[52] U.S. Cl. ..... 420/92; 420/84; 420/87; 148/332

[58] Field of Search ..... 420/92, 91, 84, 420/87; 148/332

[56] References Cited

U.S. PATENT DOCUMENTS

| | | | |
|---|---|---|---|
| 4,925,500 | 5/1990 | Kishida et al. | 148/332 |

FOREIGN PATENT DOCUMENTS

| | | |
|---|---|---|
| A1 0 319 590 | 12/1988 | European Pat. Off. . |
| 60-92450 | 5/1985 | Japan . |
| 63-93845 | 4/1988 | Japan . |
| 2-254118 | 10/1990 | Japan . |
| 4-141548 | 5/1992 | Japan . |
| 4-285118 | 10/1992 | Japan . |
| 4-70385 B2 | 11/1992 | Japan . |
| 4-371547 | 12/1992 | Japan . |
| 6-63025 | 3/1994 | Japan . |
| 7-138701 | 5/1995 | Japan . |
| 7-278743 | 10/1995 | Japan . |
| 8-144019 | 6/1996 | Japan . |
| 9-111336 | 4/1997 | Japan . |

*Primary Examiner*—Deborah Yee
*Attorney, Agent, or Firm*—Oliff & Berridge, PLC

[57] ABSTRACT

A non heat-treated steel of high strength, toughness and machinability which can be used in its as-worked state without calling for any special treatment after working. It contains less than 0.05 wt % C, 0.005 to 2.0 wt % Si, 0.5 to 5.0 wt % Mn, 0.1 to 10.0 wt % Ni, more than 1.0 to 4.0 wt % Cu, 0.0002 to 1.0 wt % Al, 0.005 to 0.50 wt % S and 0.0010 to 0.0200 wt % N.

29 Claims, 4 Drawing Sheets

◎ SMALL CHIPS (LENGTH ≦ 5mm)

○ SMALL CHIPS (LENGTH ≦ 5mm) AND SOME MEDIUM CHIPS (5mm < LENGTH ≦ 20mm)

△ MEDIUM CHIPS (5mm < LENGTH ≦ 20mm) AND SOME LARGE CHIPS (LENGTH > 20mm)

× LARGE CHIPS (LENGTH > 20mm)

HIGH-STRENGTH AND HIGH-TOUGHNESS NON HEAT-TREATED STEEL HAVING EXCELLENT MACHINABILITY

This is a 371 of PCT/JP97/03380 filed Sep. 24, 1997.

BACKGROUND OF THE INVENTION

1. Technical Field

This invention relates to a non heat-treated steel which exhibits high levels of strength, toughness and machinability without being heat-treated prior to cutting after hot rolling, and which is suitable as a machine structural steel used by cutting after hot rolling, and after hot or cold working if required.

2. Background Art

A machine structural alloy steel SCM435 or SCM440 as specified by JIS G4105 has hitherto been used for making machine structural, or automobile parts of which high levels of strength and toughness are required. These parts are usually manufactured by (1) shaping by rolling, and further by hot or cold working, if required, (2) heat treatment, such as hardening and tempering, for imparting strength and toughness to steel, and then, (3) cutting.

The structural alloy steel as mentioned above calls for heat treatment as a step (2) for achieving the strength and toughness which are required.

The heat treatment, or heat treatment requires a long time and a high cost. If heat treatment can be omitted, it is possible to realize a great reduction of cost and also a reduction of energy consumption, so various proposals have been made for that purpose.

There has, for example, been proposed a non heat-treated steel of the ferrite-pearlite type obtained by adding about 0.10 wt % of vanadium to medium-carbon steel containing maganese having a carbon content of 0.3 to 0.5 wt %. Vanadium carbonitride is precipitated during cooling after hot rolling to strengthen the ferrite, while the strength of the pearlite is relied upon for raising the strength of the steel as a whole.

Japanese Patent Publication No. Hei 6-63025 and Japanese Patent Application Laid-Open No. Hei 4-371547 disclose as hot forging steels non heat-treated steels of the bainitic or martensitic type which are produced by adding manganese, chromium, vanadium, etc. to low carbon steels having a carbon content of, say, 0.05 to 0.3 wt %.

Referring to the former non heat-treated steel of the ferrite-pearlite type, however, it is difficult to produce steel having both high tensile strength and high toughness. The carbon present in the amount of 0.3 to 0.5 wt % as the cementite in the ferrite raises the strength of steel, but lowers its toughness. Moreover, as the vanadium carbonitride precipitated in the ferrite-pearlite structure is relied upon for raising the strength of steel, only a limited range of cooling rate is applicable to produce steel which is stable in properties. It is necessary to control its cooling rate after rolling, or hot working, and its manufacturing process is accordingly complicated. Cold working, such as cold forging, makes it possible to raise the strength of steel without increasing its carbon content, but makes it impossible to obtain steel which is comparable in toughness to heat-treated steel.

The latter non heat-treated steel of the bainitic type proposed in Japanese Patent Publication No. Hei 6-63025 is inferior in yield strength to heat-treated steel when it is only hot forged. In order to raise its yield strength, it is essential to subject it to aging treatment at a temperature of 200° C. to 600° C. after hot forging and allow it to cool (in the air). Therefore, it is impossible to achieve a reduction of energy consumption as one of the merits of non heat-treated steel. No reduction of energy consumption can be achieved by the process for manufacturing high-strength and high-toughness non heat-treated steel proposed in Japanese Patent Application Laid-Open No. Hei 4-371547, either, since it calls for tempering. If this kind of steel is used for making a small part, it is easy to obtain a satisfactorily high level of toughness, since it is possible to employ a high cooling rate after hot forging. When it is used for making a large part, however, it is impossible to obtain a satisfactorily high level of toughness steadily unless the cooling rate after hot forging can be so controlled as to be sufficiently high.

Japanese Patent Applications Laid-Open Nos. Hei 8-144019 and Hei 9-111336 disclose low carbon steels containing copper and boron which exhibit a satisfactorily high level of toughness even if a low cooling rate may be employed. It is, however, often the case that the manufacture of a machine structural part includes cutting after various steps of working, such as rolling and forging, and heat treatment, as stated before. It is, therefore, essential for any industrially useful material to have not only high strength and high toughness, but also high machinability. The low carbon steels containing copper and boron are, however, not intended for achieving any practically acceptable level of machinability as required for making a machine structural part, since they are mainly intended for achieving high toughness without being heat-treated.

Moreover, Japanese Patent Application Laid-Open No. Sho 60-92450 discloses steel having its strength improved by the precipitation of copper. This steel is made by adding 0.5 to 2 wt % of copper to nitriding steel, and has its strength increased by the precipitation of copper during its nitriding. Its disclosure does not discuss anything about machinability, either. Moreover, as the steel has a carbon content of 0.05 to 0.3 wt %, its tensile strength is greatly lowered by mass effect when applied to a material, or part having a large diameter or size and thus a low cooling rate.

It is, therefore, an object of this invention to provide a non heat-treated steel which can be used as hot or cold worked, and yet exhibits high strength, high toughness and excellent machinability even when used for making a large structural part.

SUMMARY OF THE INVENTION

The present inventors of this invention, have arrived at this invention as a result of our study of the composition of a non heat-treated steel which exhibits satisfactorily high levels of tensile strength, yield strength and toughness, and also excellent machinability even when used for making a large part without undergoing any cooling at a controlled rate, or any aging after hot rolling or working. We have found means and results as stated below:

(1) Toughness improved by a great amount of carbon reduction of steel;

(2) Strength of steel improved by precipitation of copper and a solid solution of nickel;

(3) High strength and toughness achieved by the addition of manganese, and also e.g. niobium or boron, if required; and (4) Machinability improved, and fatigue strength achieved by the combination of copper and sulfur.

It is, among others, our novel discovery that copper is effective for achieving both high strength and high machinability, as stated at (2) and (4) above, insofar as these two properties have hitherto been considered as acting against each other.

This invention resides in a non heat-treated steel containing less than 0.05 wt % C, 0.005 to 2.0 wt % Si, 0.5 to 5.0 wt % Mn, 0.1 to 10.0 wt % Ni, more than 1.0 to 4.0 wt % Cu, 0.0002 to 1.0 wt % Al, 0.005 to 0.50 wt % S and 0.0010 to 0.0200 wt % N. It may further contain one or more elements of any of groups I to IV as shown below, or a combination thereof:

I. Not more than 0.5 wt % W, not more than 0.5 wt % V and not more than 0.1 wt % Ti;

II. Not more than 3.0 wt % Cr, not more than 1.0 wt % Mo, not more than 0.15 wt % Nb and not more than 0.03 wt % B;

III. Not more than 0.1 wt % Zr, not more than 0.02 wt % Mg, not more than 0.1 wt % Hf and not more than 0.02 wt % REM; and IV. Not more than 0.10 wt % P, not more than 0.30 wt % Pb, not more than 0.10 wt % Co, not more than 0.02 wt % Ca, not more than 0.05 wt % Te, not more than 0.10 wt % Se, not more than 0.05 wt % Sb and not more than 0.30 wt % Bi.

Explanation will now be made of the reasons for the limitation of the ranges of the chemical elements in the steel of this invention.

C: Less than 0.05 wt %

Steel having a carbon content of 0.05 wt % or more is likely to have its toughness lowered by the precipitation of the pearlite, depending on the cooling rate after hot rolling or working. Therefore, it has to be kept at less than 0.05 wt %, and preferably not more than 0.03 wt %.

Si: 0.005 to 2.0 wt %

At least 0.005 wt % of silicon is necessary to ensure the deoxidation of steel and its strengthening by a solid solution, but if it exceeds 2.0 wt %, it lowers the toughness of steel.

Mn: 0.5 to 5.0 wt %

At least 0.5 wt % of manganese is necessary to improve the hardenability of steel and achieve its high strength, but if it exceeds 5.0 wt %, it lowers the machinability of steel. Thus, its amount is restricted within the range of 0.5 to 5.0 wt %.

Ni: 0.1 to 10.0 wt %

Nickel is an element which is effective for improving the strength and toughness of steel, and also for preventing its hot embrittlement during rolling if it contains copper. It is, however, expensive, and even if it may be added in any amount exceeding 10.0 wt %, no better result can be expected. Therefore, its amount is restricted within the range of 0.1 to 10.0 wt %.

Cu: More than 1.0 to 4.0 wt %

Copper is added for strengthening steel by precipitation, and for improving its machinability by cooperating with sulfur. It is necessary to add more than 1.0 wt %, and preferably at least 1.5 wt % of copper in order to ensure that its addition be effective, but if it exceeds 4.0 wt %, it sharply lowers the toughness of steel. Therefore, its amount is restricted within the range of more than 1.0 to 4.0 wt %.

S: 0.005 to 0.50 wt %

Sulfur improves the machinability of steel by cooperating with copper. It is necessary to add at least 0.005 wt %, and preferably more than 0.010 wt % of sulfur in order to ensure that its addition be effective, but if it exceeds 0.50 wt %, it lowers the cleanliness and toughness of steel.

Description will now be made in detail of the results of experiments conducted for examining the effects which copper and sulfur would have on the machinability of steel.

A plurality of steel blooms having different compositions as shown in Table 1 were prepared by continuous casting, and hot rolled into bars having a diameter of 100 mm, and the steels bars were cooled from a temperature of 800° C. to 400° C. at a cooling rate of 0.001 to 80° C./s.

The steel bars which had been cooled at a rate of 0.1° C./s were tested for machinability. The results are shown in FIG. 1. The machinability tests were conducted by using an carbide tip for turning the outer periphery of each steel bar with a 200 m/min cutting speed, 0.25 mm/rev feed and 2 mm depth of cut without using any lubricant, and continuing the cutting operation until the tool had 0.2 mm flank wear, and the total time of the cutting operation was taken as the life of the tool. The tool has a life of about 500 seconds on a commonly used machine structural steel designated as SCM435QT by JIS G4105.

The chips which had been formed by the outer periphery turning tests were examined for their shapes. The results are shown in FIG. 2. In FIG. 2, each double circle shows the case in which the chips were in good shape and as small as not more than 5 mm in length, each circle shows the case in which the chips were a mixture of small ones and ones larger than 5 mm, but not larger than 20 mm in length, each triangle shows the case in which the chips were a mixture of ones larger than 5 mm, but not larger than 20 mm in length and ones larger than 20 mm in length, and each cross shows the case in which almost all of the chips were larger than 20 mm in length and adversely affected the efficiency of the turning operation.

TABLE 1

| C | Si | Mn | S | Cu | Ni | Al | N | (wt %) O |
|---|---|---|---|---|---|---|---|---|
| 0.010–0.020 | 0.30–0.40 | 1.80–2.00 | 0.001–0.05 | 0.5–3.0 | 1.30–1.40 | 0.03–0.05 | 0.001–0.004 | 0.001–0.004 |

It is obvious from FIGS. 1 and 2 that it is necessary for steel to have a copper content of more than 1.0 wt % and a sulfur content of at least 0.005 wt % in order to achieve a tool life of at least 1,000 seconds which is about twice longer than what is obtained when a common material is cut, while ensuring that the chips which are formed be in good shape. A copper content of at least 1.5 wt % and a sulfur content of more than 0.010 wt % are preferred to impart a still higher machinability to steel.

Reference is now made to FIG. 3 showing the relation as found between the rate of cooling after rolling and the tensile strength (TS) of steel. Steel containing 2.0 wt % of copper has a tensile strength of at least 900 MPa when cooled at a rate not exceeding about 5° C./s after rolling. Copper is finely precipitated during cooling and thereby serves to increase the strength of steel. An ordinary process for manufacturing steel bars employs a cooling rate not exceeding 1° C./s after rolling. It is, thus, obvious that the steel according to this invention makes it possible to achieve a high strength without calling for any control of the rate of cooling after rolling.

FIG. 4 shows an increase of strength as obtained at a cooling rate of 0.1° C./s with an increase in the proportion of copper. It is obvious from FIG. 4 that the value of ΔTS (a difference in TS from steel not containing any copper) shows a sharp increase when the proportion of copper exceeds 1.0 wt %. It is also obvious that the presence of at least 1.5 wt % of copper makes it possible to achieve a still higher strength.

It has also been a problem of the conventional steel that a steel bar is likely to have a difference in strength between its case and core portions due to its tendency to have a softer structure and a lower tensile strength at a lower cooling rate. This tendency has been remarkable in a steel bar having a large diameter, and has made it necessary to control the cooling rate for a steel bar having a large diameter. On the other hand, the strength of the steel containing copper according to this invention hardly depends upon the cooling rate, as is obvious from FIG. 3. It is, therefore, possible to avoid both any difference in strength between steel bars due to their difference in diameter and any radial variation in tensile strength due to a difference in cooling rate between the case and core portions of a bar allowed to cool.

Al: 0.0002 to 1.0 wt %

Aluminum serves as a deoxidizing agent and also forms AlN with nitrogen to form a finer structure. In this connection, steel is required to contain at least 0.0002 wt % of aluminum, but if its content exceeds 1.0 wt %, alumina-type inclusions increase and lower the toughness of steel. Its proportion is, thus, in the range of 0.0002 to 1.0 wt %.

N: 0.0010 to 0.0200 wt %

Nitrogen forms a precipitate of AlN with aluminum and it forms pinning sites for restraining the growth of crystal grains and serves to form a finer structure and improve the toughness of steel. If its proportion is less than 0.0010 wt %, no satisfactory precipitation of AlN occurs, but if it exceeds 0.0200 wt %, no better result can be expected, but a solid solution of nitrogen lowers the toughness of steel. Its proportion is, therefore, in the range of 0.0010 to 0.0200 wt %.

The steel of this invention may further contain other chemical elements, as shown below, to have a still higher strength and exhibit an improved machinability when cut to make a final product.

It is beneficial to add one or more of not more than 0.5 wt % of tungsten, not more than 0.5 wt % of vanadium and not more than 0.1 wt % of titanium to improve the strength of steel.

W: Not more than 0.5 wt %

Tungsten forms a solid solution to strengthen steel and also reacts with carbon to form a precipitate of WC which acts effectively to increase its strength. If its proportion exceeds 0.5 wt %, however, it brings about a sharp reduction in toughness.

V: Not more than 0.5 wt %

Vanadium forms a precipitate of V(C,N) to strengthen steel, and the precipitate of V(C,N) formed in the austenitic region serves to form nuclei for the growth of ferrite and thereby enable the formation of a finer structure and an improvement of toughness. If its proportion exceeds 0.5 wt %, however, no better result can be expected, but it brings about a problem such as cracking during continuous casting.

Ti: Not more than 0.1 wt %

Titanium strengthens steel by precipitation, fixes carbon or nitrogen to improve its toughness, and also serves as a deoxidizing agent. If too much titanium exists, however, it forms a coarse precipitate of TiN which lowers the toughness of steel. Its proportion is, therefore, not more than 0.1 wt %.

It is beneficial to add one or more of not more than 3.0 wt % of chromium, not more than 1.0 wt % of molybdenum, not more than 0.15 wt % of niobium and not more than 0.03 wt % of boron in order to improve the hardenability of steel and thereby its strength.

Cr: Not more than 3.0 wt %

Chromium is effective for increasing strength, but if any excess thereof exists, it lowers toughness, and its proportion is, therefore, not more than 3.0 wt %.

Mo: Not more than 1.0 wt %

Molybdenum is effective for increasing strength at normal and elevated temperatures, but is expensive, and its proportion is, therefore, not more than 1.0 wt %.

Nb: Not more than 0.15 wt %

Niobium is effective for improving the hardenability of steel, strengthening it by precipitation and improving its toughness, but if its proportion exceeds 0.15 wt %, it has an adverse effect on the hot rolling property of steel.

B: Not more than 0.03 wt %

Boron improves hardenability, but even if more than 0.03 wt % may exist, no better result can be expected. Its proportion is, therefore, not more than 0.03 wt %.

For deoxidation, and for dividing the crystal grains finely for improved toughness, it is beneficial to add one or more of not more than 0.1 wt % of zirconium, not more than 0.02 wt % of magnesium, not more than 0.1 wt % of hafnium and not more than 0.02 wt % of REM.

Zr: Not more than 0.1 wt %

Zirconium is a deoxidizing agent and is also effective for dividing the crystal grains finely to achieve an improved strength and toughness, but even if its proportion may exceed 0.1 wt %, no better result can be expected.

Mg: Not more than 0.02 wt %

Magnesium is a deoxidizing agent and is also effective for dividing the crystal grains finely to achieve an improved strength and toughness, but even if its proportion may exceed 0.02 wt %, no better result can be expected.

Hf: Not more than 0.1 wt %

Hafnium is effective for dividing the crystal grains finely to achieve an improved strength and toughness, but even if its proportion may exceed 0.1 wt %, no better result can be expected.

REM: Not more than 0.02 wt %

REM is effective for dividing the crystal grains finely to achieve an improved strength and toughness, but even if its proportion may exceed 0.02 wt %, no better result can be expected.

For a further improvement of its machinability, the steel may contain one or more of not more than 0.10 wt % of phosphorus, not more than 0.30 wt % of lead, not more than 0.10 wt % of cobalt, not more than 0.02 wt % of calcium, not more than 0.05 wt % of tellurium, not more than 0.10 wt % of selenium, not more than 0.05 wt % of antimony and not more than 0.30 wt % of bismuth.

P: Not more than 0.10 wt %

Phosphorus can be added to improve machinability, but its proportion should not be more than 0.10 wt %, since it has an adverse effect on toughness and fatigue strength.

Pb: Not more than 0.30 wt %

Lead is an element having such a low melting point that it is melted by the heat generated by steel when it is cut, and exhibit a liquid lubricant action to improve its machinability, but if its proportion exceeds 0.30 wt %, no better result can be expected, but it lowers the fatigue strength of steel.

Co: Not more than 0.10 wt %

Ca: Not more than 0.02 wt %

Te: Not more than 0.05 wt %

Sb: Not more than 0.05 wt %

Bi: Not more than 0.30 wt %

Cobalt, calcium, tellurium, antimony and bismuth improve machinability, as lead does, but even if they may be added in excess of 0.10 wt %, 0.02 wt %, 0.05 wt %, 0.05 wt % and 0.30 wt %, respectively, no better result can be expected, but they lower the fatigue strength of steel.

Se: Not more than 0.10 wt %

Selenium combines with manganese to form MnSe which acts as a chip breaker to improve machinability. If its proportion exceeds 0.10 wt %, however, it has an adverse effect on fatigue strength.

All of these additional elements are effective, even if their proportion may be as small as 0.001 wt %.

The non heat-treated steel of this invention having its basic composition as stated above exhibits high strength, high toughness and high machinability, even if it may have a low cooling rate after rolling or hot working. Therefore, it is not necessary to control strictly the conditions for cooling after rolling or hot working, but it is possible to employ the conditions which are usually employed for rolling machine structural steels, and for manufacturing parts.

For example, a hot rolled steel bar having the basic composition as stated above may be heated to 1200° C., be hot rolled or forged at a temperature of 1000° C. to 1200° C. into a specific shape, and be allowed to cool in the air, or cooled slowly to yield a product having properties as intended.

Although the hot rolled or forged product does not require any special treatment, it is also possible to cool it to room temperature and reheat it at a temperature of at least 300° C., but below 800° C. for at least 30 seconds in order to increase its strength.

The steel having the basic composition as stated before can also be used for cold working after hot rolling and cooling to room temperature. Cold working may be cold rolling, drawing or forging, but is not restricted to these.

If high toughness is required, steel may be held at a temperature of at least 300° C., but below 800° C. for at least 30 seconds after cold working.

Moreover, the steel of this invention can be used for purposes involving cutting after heat treatment which is usually employed for automobile parts (such as carburizing, carbonitriding, nitriding or softnitriding), or for rolling or sliding parts, or spring steel owing to its high strength, toughness and fatigue strength.

DETAILED DESCRIPTION OF THE PREFERRED EMBODIMENTS

EXAMPLE 1

Figure 1:
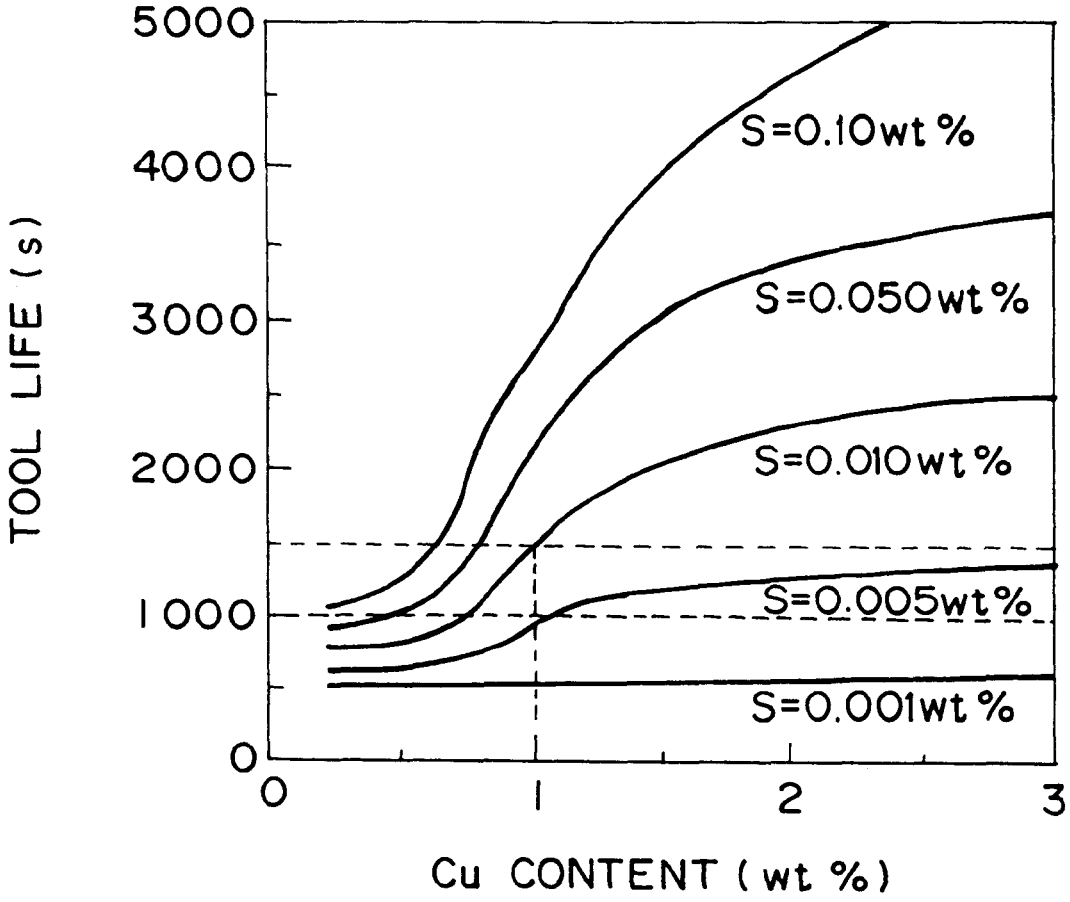
FIG. 1 is a graph showing the effects of the proportion of copper on the life of a tool.

A plurality of blooms were prepared by continuous casting from each of steels having chemical compositions as shown in Tables 2 to 5. The blooms were hot rolled into bars having diameters of 40 mmø, 200 mmø and 400 mmø, and the bars were cooled from 800° C. to 400° C. at a cooling rate of 0.1° C./s or 0.5° C./s. Some of the bars were slowly cooled from 800° C. to 400° C. at a cooling rate of 0.002° C./s to 0.01° C./s. A part of the bars having a diameter of 40 mmø were rapidly cooled from 800° C. to 400° C. at a cooling rate of 5° C./s. Moreover, a portion of the bars were heat treated by holding at 550° C. for 40 minutes.

The conventional non heat-treated steels shown as steels 54 and 55 in Table 5 were cooled at a rate of 0.5° C./min, 0.1° C./min or 0.002° C./min after rolling, as the steels of this invention were, and the heat-treated steels conforming to JIS and shown as steels 56 to 58 were heated at 880° C. for an hour after rolling, were quenched in oil having a temperature of 60° C., and were tempered at 580° C. for an hour.

The steel bars were, then, tested for mechanical properties. The results are shown in Tables 6 and 7.

Tensile tests were conducted for determining the yield strength (YS), tensile strength (TS), elongation (El) and reduction of area (RA) of a tensile testpiece (JIS #4) taken from each bar at a point spaced apart from its case by a distance equal to ¼ of its diameter. Impact tests were conducted for determining at a temperature of 20° C. the impact value ($uE_{20}$) of an impact testpiece (JIS #3) taken from each bar at a point spaced apart from its case by a distance equal to ¼ of its diameter. The fatigue limit ratio is the ratio of fatigue strength to tensile strength as determined by testing a rotary bending testpiece (JIS #1 smooth testpiece) at a rotating speed of 4000 rpm.

TABLE 2

| Steel | C | Si | Mn | S | Cu | Ni | Al | N | Others | O | Remarks |
|---|---|---|---|---|---|---|---|---|---|---|---|
| 1 | 0.008 | 0.27 | 2.07 | 0.015 | 2.20 | 1.18 | 0.034 | 0.0018 | — | 0.0028 | Invention |
| 2 | 0.046 | 0.27 | 2.06 | 0.016 | 2.13 | 1.15 | 0.034 | 0.0023 | — | 0.0020 | " |
| 3 | 0.011 | 1.68 | 2.08 | 0.020 | 2.18 | 1.23 | 0.037 | 0.0032 | — | 0.0028 | " |
| 4 | 0.01i | 0.32 | 0.78 | 0.018 | 2.11 | 1.19 | 0.041 | 0.0033 | — | 0.0031 | " |
| 5 | 0.012 | 0.33 | 4.80 | 0.022 | 2.22 | 1.21 | 0.033 | 0.0026 | — | 0.0022 | " |
| 6 | 0.012 | 0.25 | 1.98 | 0.007 | 1.97 | 0.94 | 0.041 | 0.0030 | — | 0.0022 | " |
| 7 | 0.008 | 0.18 | 2.05 | 0.41 | 2.18 | 1.21 | 0.033 | 0.0021 | — | 0.0021 | " |
| 8 | 0.008 | 0.26 | 2.51 | 0.018 | 1.13 | 1.06 | 0.036 | 0.0028 | — | 0.0023 | " |
| 9 | 0.009 | 0.24 | 1.98 | 0.021 | 3.82 | 1.08 | 0.041 | 0.0029 | — | 0.0022 | " |
| 10 | 0.007 | 0.25 | 1.88 | 0.019 | 2.15 | 0.30 | 0.021 | 0.0024 | — | 0.0021 | " |
| 11 | 0.009 | 0.27 | 1.92 | 0.021 | 2.06 | 9.80 | 0.033 | 0.0026 | — | 0.0026 | " |
| 12 | 0.008 | 0.28 | 1.75 | 0.032 | 2.11 | 1.82 | 0.001 | 0.0025 | — | 0.0028 | " |
| 13 | 0.010 | 0.26 | 1.88 | 0.024 | 2.08 | 1.33 | 0.88 | 0.0028 | — | 0.0027 | " |
| 14 | 0.011 | 0.24 | 1.81 | 0.022 | 1.87 | 1.42 | 0.033 | 0.0162 | — | 0.0026 | " |
| 15 | 0.012 | 0.28 | 1.92 | 0.048 | 2.37 | 1.06 | 0.008 | 0.0028 | Ti: 0.050 | 0.0033 | " |
| 16 | 0.009 | 0.24 | 1.83 | 0.024 | 2.22 | 1.42 | 0.032 | 0.0081 | V: 0.12 | 0.0029 | " |
| 17 | 0.015 | 0.26 | 2.14 | 0.014 | 1.99 | 2.08 | 0.033 | 0.0026 | W: 0.02 | 0.0031 | " |

TABLE 3

| Steel | C | Si | Mn | S | Cu | Ni | Al | N | Others | O | Remarks |
|---|---|---|---|---|---|---|---|---|---|---|---|
| 18 | 0.013 | 0.32 | 1.90 | 0.022 | 2.09 | 1.09 | 0.030 | 0.0018 | Nb: 0.040 | 0.0026 | Invention |
| 19 | 0.009 | 0.52 | 1.79 | 0.028 | 2.11 | 1.20 | 0.023 | 0.0019 | Cr: 0.82 | 0.0040 | " |
| 20 | 0.006 | 0.42 | 2.37 | 0.037 | 2.14 | 1.83 | 0.021 | 0.0018 | Mo: 0.25 | 0.0039 | " |

TABLE 3-continued

| Steel | C | Si | Mn | S | Cu | Ni | Al | N | Others | O | Remarks |
|---|---|---|---|---|---|---|---|---|---|---|---|
| 21 | 0.012 | 0.51 | 1.72 | 0.021 | 2.26 | 1.20 | 0.029 | 0.0017 | B: 0.0030 | 0.0032 | " |
| 22 | 0.011 | 0.27 | 1.93 | 0.032 | 2.13 | 1.11 | 0.023 | 0.0029 | Ti: 0.045, Nb: 0.032 | 0.0035 | " |
| 23 | 0.009 | 0.24 | 1.83 | 0.024 | 2.22 | 1.42 | 0.033 | 0.0096 | V: 0.080, Cr: 1.2 | 0.0029 | " |
| 24 | 0.010 | 0.32 | 1.90 | 0.022 | 2.05 | 1.09 | 0.022 | 0.0031 | Ti: 0.042, Mo: 0.8 | 0.0026 | " |
| 25 | 0.008 | 0.31 | 1.96 | 0.026 | 2.09 | 1.12 | 0.036 | 0.0086 | V: 0.092, B: 0.0020 | 0.0025 | " |
| 26 | 0.015 | 0.31 | 1.96 | 0.035 | 2.34 | 1.14 | 0.024 | 0.0025 | Zr: 0.010 | 0.0011 | " |
| 27 | 0.041 | 0.24 | 1.80 | 0.031 | 2.03 | 1.12 | 0.120 | 0.0026 | Mg: 0.012 | 0.0012 | " |
| 28 | 0.012 | 0.30 | 2.18 | 0.026 | 2.07 | 1.21 | 0.028 | 0.0074 | Ti: 0.041, Hf: 0.020 | 0.0011 | " |
| 29 | 0.019 | 0.52 | 1.90 | 0.022 | 2.08 | 1.20 | 0.029 | 0.0110 | V: 0.090, REM: 0.001 | 0.0013 | " |
| 30 | 0.013 | 0.33 | 2.09 | 0.023 | 2.13 | 1.11 | 0.048 | 0.0033 | P: 0.052 | 0.0027 | " |
| 31 | 0.007 | 0.27 | 2.06 | 0.016 | 2.19 | 1.32 | 0.034 | 0.0021 | Pb: 0.16 | 0.0021 | " |
| 32 | 0.009 | 0.28 | 2.12 | 0.018 | 2.13 | 1.25 | 0.035 | 0.0019 | Co: 0.05 | 0.0024 | " |
| 33 | 0.008 | 0.29 | 2.03 | 0.019 | 2.09 | 1.15 | 0.036 | 0.0022 | Ca: 0.009 | 0.0023 | " |
| 34 | 0.008 | 0.30 | 2.22 | 0.021 | 2.22 | 1.16 | 0.041 | 0.0023 | Te: 0.005 | 0.0021 | " |
| 35 | 0.010 | 0.32 | 2.19 | 0.033 | 2.16 | 1.21 | 0.052 | 0.0025 | Se: 0.03 | 0.0025 | " |
| 36 | 0.011 | 0.33 | 2.08 | 0.026 | 2.28 | 1.24 | 0.042 | 0.0026 | Sb: 0.02 | 0.0032 | " |
| 37 | 0.009 | 0.41 | 1.98 | 0.024 | 1.96 | 1.32 | 0.036 | 0.0033 | Bi: 0.02 | 0.0026 | " |
| 38 | 0.010 | 0.32 | 2.05 | 0.022 | 1.88 | 1.05 | 0.039 | 0.0025 | Ti: 0.032, P: 0.021 | 0.0021 | " |
| 39 | 0.011 | 0.41 | 1.89 | 0.016 | 2.32 | 0.96 | 0.041 | 0.0021 | Ti: 0.036, Fb: 0.16 | 0.0020 | " |
| 40 | 0.008 | 0.32 | 2.03 | 0.018 | 2.09 | 1.97 | 0.033 | 0.0018 | V: 0.086, Ca: 0.004 | 0.0023 | " |
| 41 | 0.019 | 0.32 | 1.46 | 0.011 | 1.74 | 0.20 | 0.0003 | 0.0024 | Ti: 0.021, Zr: 0.019, P: 0.009 | 0.0048 | " |

TABLE 4

| Steel | C | Si | Mn | S | Cu | Ni | Al | N | O | Remarks |
|---|---|---|---|---|---|---|---|---|---|---|
| 42 | 0.058 | 0.26 | 2.02 | 0.015 | 2.08 | 1.06 | 0.040 | 0.0028 | 0.0021 | Comparative |
| 43 | 0.012 | 0.003 | 2.09 | 0.017 | 2.17 | 1.10 | 0.030 | 0.0031 | 0.0081 | " |
| 44 | 0.010 | 2.10 | 2.04 | 0.021 | 2.02 | 1.03 | 0.032 | 0.0029 | 0.0022 | " |
| 45 | 0.018 | 0.32 | 0.42 | 0.031 | 2.18 | 1.28 | 0.051 | 0.0028 | 0.0021 | " |
| 46 | 0.020 | 0.33 | 5.20 | 0.041 | 1.94 | 1.27 | 0.048 | 0.0033 | 0.0021 | " |
| 47 | 0.022 | 0.42 | 1.88 | 0.023 | 2.23 | 0.08 | 0.021 | 0.0031 | 0.0028 | " |
| 48 | 0.011 | 0.28 | 2.03 | 0.017 | 0.85 | 0.99 | 0.029 | 0.0041 | 0.0031 | " |
| 49 | 0.012 | 0.31 | 2.06 | 0.019 | 4.21 | 1.48 | 0.055 | 0.0033 | 0.0026 | " |
| 50 | 0.014 | 0.25 | 2.06 | 0.002 | 2.10 | 1.05 | 0.038 | 0.0031 | 0.0029 | " |
| 51 | 0.021 | 0.40 | 1.03 | 0.054 | 2.38 | 9.40 | 0.0008 | 0.0030 | 0.0092 | " |
| 52 | 0.012 | 0.23 | 2.10 | 0.092 | 2.33 | 1.37 | 1.10 | 0.0029 | 0.0031 | " |
| 53 | 0.013 | 0.05 | 1.89 | 0.024 | 2.13 | 1.23 | 0.021 | 0.0230 | 0.0029 | " |

TABLE 5

| Steel | C | Si | Mn | S | Cu | Ni | Al | N | Others | Remarks |
|---|---|---|---|---|---|---|---|---|---|---|
| 54 | 0.020 | 1.24 | 1.53 | 0.055 | 0.45 | 0.02 | 0.002 | 0.0030 | Ti: 0.020, V: 0.150, Nb: 0.012, Cr: 0.21, P: 0.017 | Comparative |
| 55 | 0.450 | 0.25 | 1.35 | 0.045 | 0.02 | 0.03 | 0.001 | 0.0031 | V: 0.120, P: 0.015 | " |
| 56 | 0.350 | 0.22 | 0.75 | 0.012 | 0.02 | 0.04 | 0.035 | 0.0028 | Cr: 1.10, P: 0.012, Mo: 0.21 | " |
| 57 | 0.420 | 0.25 | 0.85 | 0.018 | 0.01 | 0.03 | 0.025 | 0.0032 | Cr: 1.09, P: 0.011, Mo: 0.23 | " |
| 58 | 0.420 | 0.23 | 0.87 | 0.106 | 0.01 | 0.05 | 0.026 | 0.0027 | Cr: 1.,07, P: 0.010, Mo: 0.26, Pb: 0.21 | " |

Note: 54 and 55 are Conventional non heat-treated, steels and 56, 57 and 58 are heat-treated steels Conforming to JIS.

Figure 2:
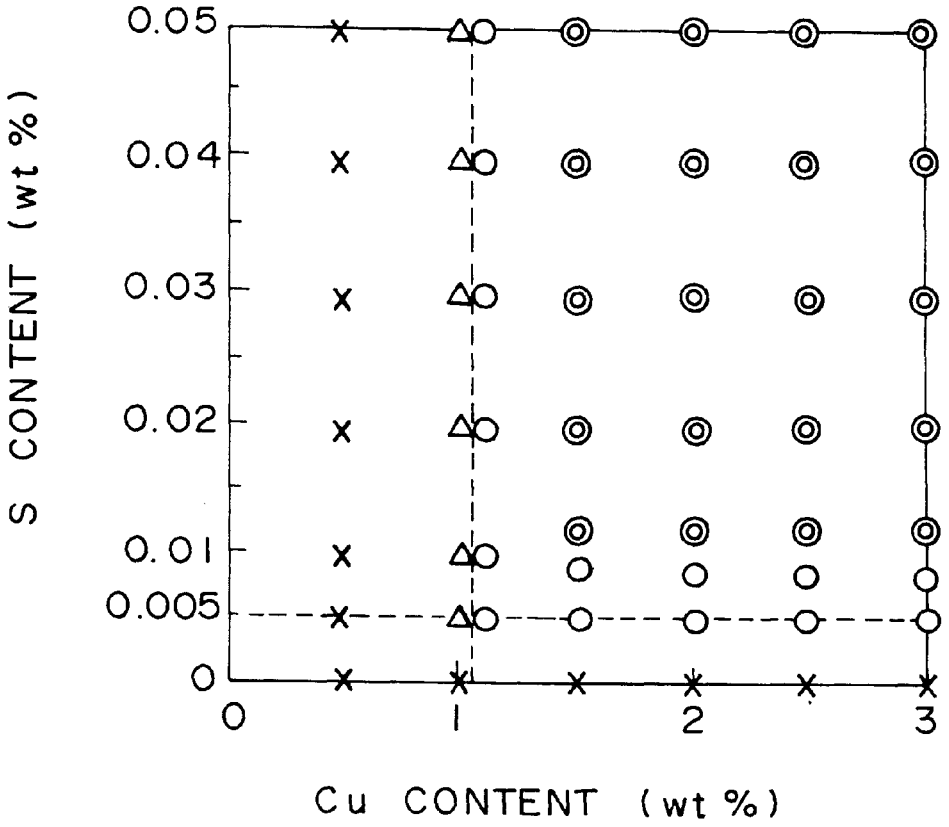
FIG. 2 is a graph showing the effects of the proportions of copper and sulfur on the nature of chips.
Figure 3:
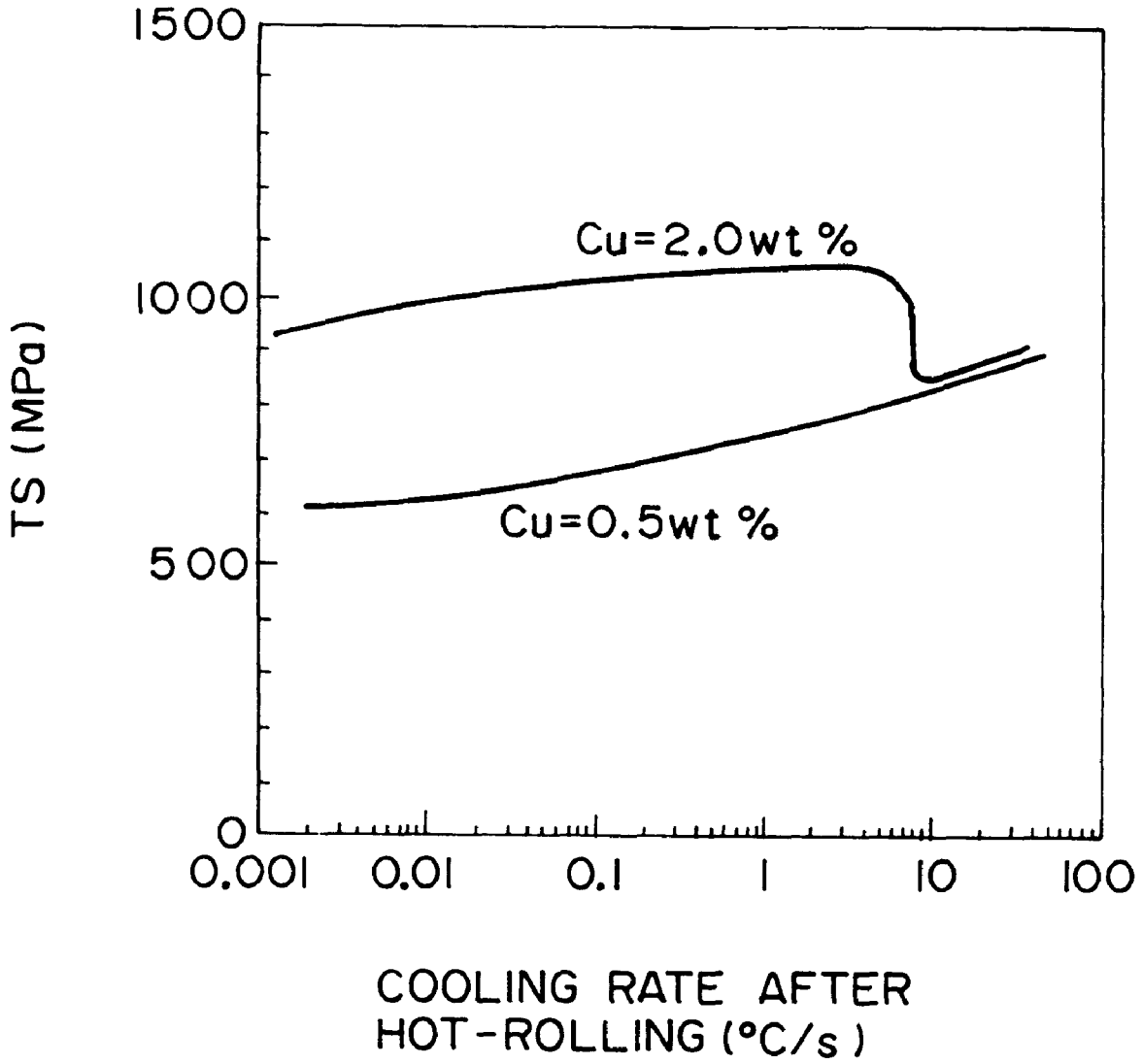
FIG. 3 is a graph showing the effects of the rate of cooling after rolling on tensile strength.
Figure 4:
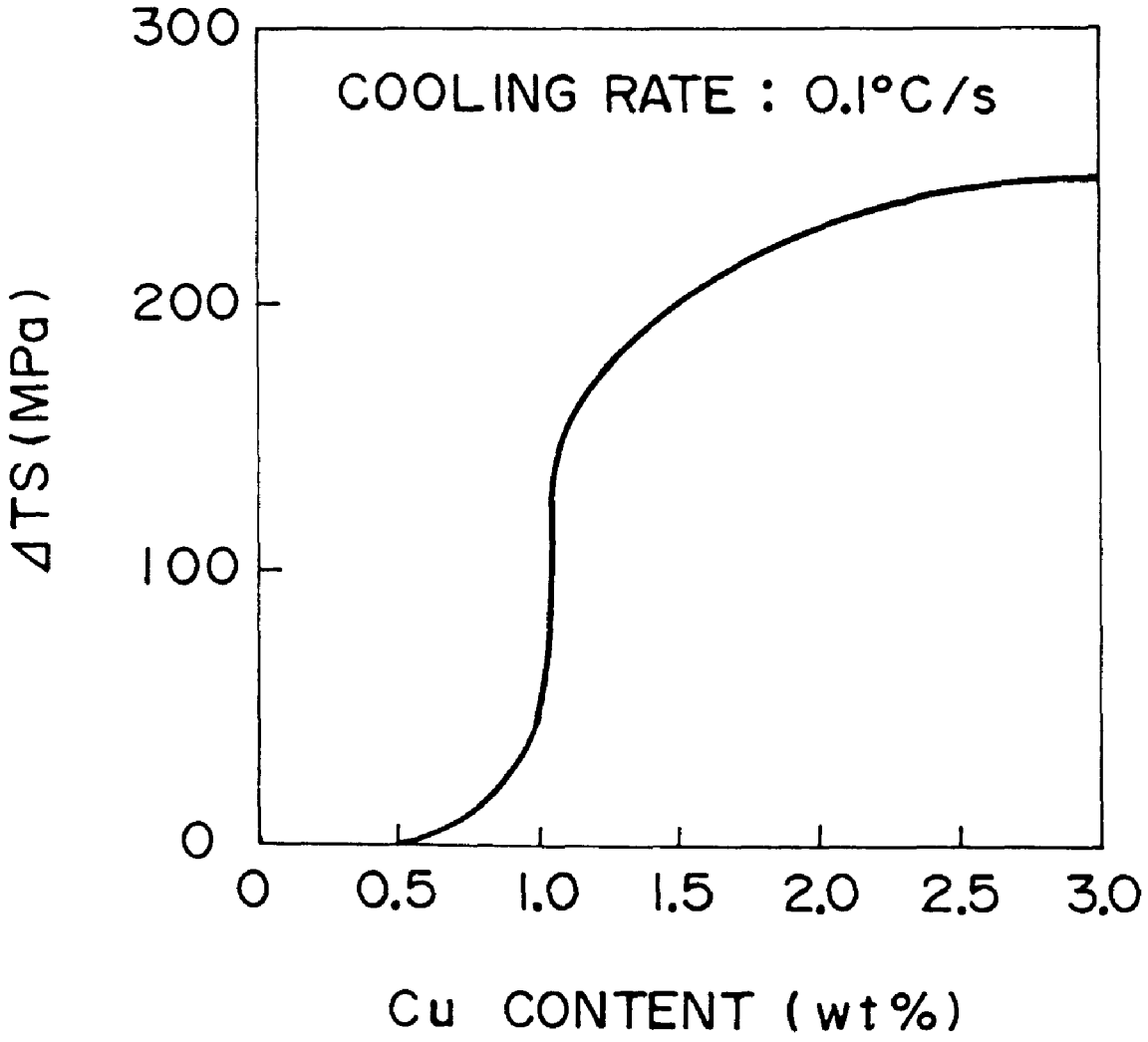
FIG. 4 is a graph showing the effects of the proportion of copper on an increase of strength.

The machinability of each steel was determined by repeating the tests of which the results are shown in FIG. 1, and the evaluation of chips was made by repeating the tests of which the results are shown in FIG. 2.

As is obvious from Tables 6 and 7, the steels according to this invention showed a high strength, TS, of at least 827 MPa irrespective of the size of the bar as rolled and the rate of cooling after hot rolling. Moreover, they were satisfactorily high in ductility, too, as confirmed by an El value of at least 19% and an RA value of at least 60%. They were also very high in toughness as confirmed by an impact value, $uE_{20}$, of at least 121 J/cm$^2$.

They were superior in machinability to the conventional non heat-treated steels 54 and 55. While the addition of a free-cutting element to a conventional heat-treated steel lowered its fatigue limit ratio as is obvious from a comparison of Comparative Steels 57 and 58, the steels of this invention showed a high fatigue limit ratio owing to a fine precipitate of copper preventing a reduction of their fatigue limit ratio by the free-cutting element added.

Comparative steel 42 was low in toughness due to its carbon content exceeding the range as defined by this invention. Steel 43 showed a low fatigue limit ratio due to its high oxygen content, since its silicon content was lower than the range as defined by this invention. Steel 44 was low in toughness due to its silicon content exceeding the range as defined by this invention. Steel 45 was low in strength due to its manganese content lower than the range as defined by this invention. Steel 46 was low in toughness due to its manganese content exceeding the range as defined by this invention. Steel 47 showed hot embrittlement during rolling due to its nickel content lower than the range as defined by this invention. Due to its copper content lower than the range as defined by this invention, steel 48 was low in strength, and unacceptable in the nature of chips resulting from the outer peripheral turning of the bar. Steel 49 was low in toughness due to its copper content exceeding the range as defined by this invention. Steel 50 was poor in machinability and poor in the nature of chips due to its sulfur content lower than the range as defined by this invention. Steel 52 was low in toughness due to its aluminum content exceeding the range as defined by this invention. Steel 53 was low in toughness due to its nitrogen content exceeding the range as defined by this invention.

The conventional non heat-treated steel 55 showed a great dependence of its strength, ductility and toughness on the cooling rate. Steel 55 having a ferrite-pearlite structure showed a TS of as low as 745 MPa even at a high cooling rate and a still lower TS at a low cooling rate. Its toughness was only about 38 J/cm$^2$ even at a high cooling rate and only about 28 J/cm$^2$ at a low cooling rate.

TABLE 6

| Steel | Diameter as rolled (mmϕ) | Rate of cooling after hot rolling (° C./s) | Reheating | YS (MPa) | TS (MPa) | El (%) | RA (%) | uE$_{20}$ (J/cm$^2$) | Fatigue limit ratio | Tool life (s) | Nature of chips | Remarks |
|---|---|---|---|---|---|---|---|---|---|---|---|---|
| 1 | 40 | 0.5 | — | 741 | 918 | 26 | 72 | 209 | 0.53 | 2855 | ⊙ | Invention |
| 1 | 40 | 0.5 | 550° C., 40 min | 763 | 942 | 24 | 68 | 200 | 0.53 | 2450 | ⊙ | " |
| 1 | 40 | 5 | 550° C., 40 min | 764 | 938 | 24 | 68 | 202 | 0.52 | 2260 | ⊙ | " |
| 1 | 200 | 0.1 | — | 745 | 920 | 26 | 72 | 208 | 0.53 | 2720 | ⊙ | " |
| 1 | 400 | 0.01 | — | 738 | 916 | 26 | 72 | 210 | 0.53 | 2835 | ⊙ | " |
| 1 | 400 | 0.002 | — | 729 | 911 | 26 | 72 | 211 | 0.53 | 2975 | ⊙ | " |
| 2 | 200 | 0.1 | — | 743 | 941 | 24 | 68 | 200 | 0.51 | 2580 | ⊙ | " |
| 3 | 200 | 0.1 | — | 762 | 964 | 23 | 67 | 192 | 0.52 | 2965 | ⊙ | " |
| 4 | 200 | 0.1 | — | 684 | 845 | 27 | 73 | 235 | 0.51 | 2805 | ⊙ | " |
| 5 | 200 | 0.1 | — | 837 | 1059 | 21 | 63 | 158 | 0.53 | 3090 | ⊙ | " |
| 6 | 200 | 0.1 | — | 695 | 869 | 27 | 73 | 227 | 0.54 | 1885 | ⊙ | " |
| 7 | 200 | 0.1 | — | 757 | 912 | 26 | 72 | 211 | 0.53 | 5745 | ⊙ | " |
| 8 | 200 | 0.1 | — | 667 | 827 | 28 | 75 | 242 | 0.53 | 1950 | ⊙ | " |
| 9 | 200 | 0.1 | — | 987 | 1234 | 19 | 60 | 121 | 0.54 | 4530 | ⊙ | " |
| 10 | 200 | 0.1 | — | 717 | 885 | 27 | 73 | 221 | 0.52 | 2890 | ⊙ | " |
| 11 | 200 | 0.1 | — | 807 | 1022 | 21 | 63 | 171 | 0.52 | 2900 | ⊙ | " |
| 12 | 200 | 0.1 | — | 745 | 897 | 27 | 73 | 216 | 0.53 | 3320 | ⊙ | " |
| 13 | 200 | 0.1 | — | 704 | 891 | 27 | 73 | 219 | 0.53 | 3035 | ⊙ | " |
| 14 | 200 | 0.1 | — | 706 | 872 | 28 | 75 | 226 | 0.52 | 2870 | ⊙ | " |
| 15 | 40 | 0.5 | — | 758 | 960 | 22 | 65 | 194 | 0.53 | 3950 | ⊙ | " |
| 15 | 200 | 0.1 | — | 753 | 953 | 22 | 65 | 196 | 0.51 | 4010 | ⊙ | " |
| 15 | 400 | 0.002 | — | 747 | 946 | 22 | 65 | 199 | 0.51 | 3985 | ⊙ | " |
| 16 | 200 | 0.1 | — | 761 | 951 | 2i | 63 | 197 | 0.53 | 3170 | ⊙ | " |
| 17 | 200 | 0.1 | — | 736 | 932 | 22 | 65 | 204 | 0.52 | 2485 | ⊙ | " |
| 18 | 40 | 0.5 | — | 726 | 931 | 24 | 68 | 204 | 0.52 | 2965 | ⊙ | Invention |
| 18 | 200 | 0.1 | — | 725 | 929 | 24 | 68 | 265 | 0.54 | 2965 | ⊙ | " |
| 18 | 400 | 0.002 | — | 717 | 919 | 24 | 68 | 208 | 0.52 | 2870 | ⊙ | " |
| 19 | 200 | 0.1 | — | 750 | 937 | 23 | 67 | 202 | 0.51 | 3200 | ⊙ | " |
| 20 | 200 | 0.1 | — | 770 | 951 | 24 | 68 | 197 | 0.53 | 3485 | ⊙ | " |
| 21 | 200 | 0.1 | — | 753 | 941 | 23 | 67 | 200 | 0.52 | 3085 | ⊙ | " |
| 22 | 200 | 0.1 | — | 773 | 931 | 23 | 67 | 204 | 0.53 | 3345 | ⊙ | " |
| 23 | 200 | 0.1 | — | 808 | 997 | 20 | 62 | 180 | 0.5W | 3170 | ⊙ | " |
| 24 | 200 | 0.1 | — | 751 | 939 | 23 | 67 | 201 | 0.53 | 2930 | ⊙ | " |
| 25 | 200 | 0.1 | — | 735 | 930 | 23 | 67 | 204 | 0.52 | 3115 | ⊙ | " |
| 26 | 40 | 0.5 | — | 755 | 956 | 24 | 68 | 255 | 0.54 | 3585 | ⊙ | " |
| 26 | 200 | 0.1 | — | 750 | 949 | 26 | 72 | 248 | 0.55 | 3655 | ⊙ | " |
| 26 | 400 | 0.002 | — | 743 | 940 | 25 | 70 | 236 | 0.55 | 3745 | ⊙ | " |
| 27 | 200 | 0.1 | — | 722 | 903 | 27 | 73 | 262 | 0.55 | 3210 | ⊙ | " |
| 28 | 200 | 0.1 | — | 718 | 909 | 27 | 73 | 271 | 0.55 | 3095 | ⊙ | " |
| 29 | 200 | 0.1 | — | 756 | 933 | 26 | 72 | 249 | 0.56 | 2955 | ⊙ | " |

TABLE 7

| Steel | Diameter as rolled (mmϕ) | Rate of cooling after hot rolling (° C./s) | Reheating | YS (MPa) | TS (MPa) | El (%) | RA (%) | uE$_{20}$ (J/cm$^2$) | Fatigue limit ratio | Tool life (s) | Nature of chips | Remarks |
|---|---|---|---|---|---|---|---|---|---|---|---|---|
| 30 | 40 | 0.5 | — | 764 | 921 | 26 | 72 | 208 | 0.52 | 4765 | ⊙ | Invention |
| 30 | 200 | 0.1 | — | 757 | 912 | 27 | 73 | 211 | 0.53 | 4570 | ⊙ | " |
| 30 | 400 | 0.002 | — | 754 | 909 | 27 | 73 | 212 | 0.53 | 4156 | ⊙ | " |
| 31 | 200 | 0.1 | — | 734 | 918 | 25 | 70 | 209 | 0.52 | 4980 | ⊙ | " |
| 32 | 200 | 0.1 | — | 720 | 911 | 26 | 71 | 211 | 0.52 | 5360 | ⊙ | " |
| 33 | 200 | 0.1 | — | 726 | 869 | 26 | 72 | 217 | 0.53 | 4820 | ⊙ | " |
| 34 | 200 | 0.1 | — | 773 | 931 | 23 | 67 | 204 | 0.54 | 5770 | ⊙ | " |
| 35 | 200 | 0.1 | — | 746 | 921 | 22 | 65 | 208 | 0.52 | 6465 | ⊙ | " |

TABLE 7-continued

| Steel | Diameter as rolled (mmφ) | Rate of cooling after hot rolling (° C./s) | Reheating | YS (MPa) | TS (MPa) | El (%) | RA (%) | $uE_{20}$ ($J/cm^2$) | Fatigue limit ratio | Tool life (s) | Nature of chips | Remarks |
|---|---|---|---|---|---|---|---|---|---|---|---|---|
| 36 | 200 | 0.1 | — | 744 | 942 | 24 | 68 | 200 | 0.53 | 5620 | ◎ | " |
| 37 | 200 | 0.1 | — | 701 | 876 | 28 | 75 | 224 | 0.52 | 6420 | ◎ | " |
| 38 | 200 | 0.1 | — | 691 | 886 | 28 | 75 | 220 | 0.53 | 3760 | ◎ | " |
| 39 | 200 | 0.1 | — | 754 | 942 | 24 | 68 | 200 | 0.53 | 6615 | ◎ | " |
| 40 | 200 | 0.1 | — | 739 | 935 | 26 | 71 | 203 | 0.54 | 5855 | ◎ | " |
| 41 | 200 | 0.1 | — | 690 | 852 | 28 | 75 | 233 | 0.53 | 2755 | ◎ | " |
| 42 | 200 | 0.1 | — | 779 | 939 | 24 | 68 | 58 | 0.51 | 2620 | ◎ | Comparative |
| 43 | 200 | 0.1 | — | 727 | 909 | 26 | 72 | 212 | 0.38 | 2805 | ◎ | " |
| 44 | 200 | 0.1 | — | 733 | 940 | 24 | 68 | 48 | 0.51 | 2860 | ◎ | " |
| 45 | 200 | 0.1 | — | 526 | 723 | 27 | 73 | 234 | 0.50 | 3365 | ◎ | " |
| 46 | 200 | 0.1 | — | 836 | 1032 | 20 | 62 | 52 | 0.50 | 3340 | ○ | " |
| 47 | 200 | 0.1 | — | — | — | — | — | — | — | — | — | (Hot embrittlement) |
| 48 | 200 | 0.1 | — | 508 | 651 | 32 | 82 | 306 | 0.50 | 1670 | X | Comparative |
| 49 | 200 | 0.1 | — | 1074 | 1326 | 17 | 57 | 60 | 0.51 | 4730 | ◎ | " |
| 50 | 200 | 0.1 | — | 704 | 902 | 26 | 72 | 215 | 0.49 | 620 | X | " |
| 51 | 200 | 0.1 | — | 853 | 1093 | 22 | 65 | 145 | 0.28 | 4130 | ◎ | " |
| 52 | 200 | 0.1 | — | 771 | 952 | 23 | 67 | 49 | 0.52 | 4526 | ◎ | " |
| 53 | 200 | 0.1 | — | 717 | 896 | 27 | 73 | 37 | 0.51 | 3083 | ◎ | " |
| 54 | 40 | 0.5 | — | 568 | 838 | 20 | 58 | 64 | 0.51 | 468 | X | Comparative |
| 54 | 200 | 0.1 | — | 554 | 804 | 20 | 59 | 62 | 0.51 | 498 | X | " |
| 54 | 400 | 0.002 | — | 506 | 724 | 26 | 68 | 82 | 0.50 | 468 | X | " |
| 55 | 40 | 0.5 | — | 529 | 745 | 21 | 60 | 38 | 0.49 | 556 | X | " |
| 55 | 200 | 0.1 | — | 505 | 715 | 20 | 58 | 31 | 0.49 | 592 | X | " |
| 55 | 400 | 0.002 | — | 462 | 674 | 24 | 64 | 28 | 0.50 | 514 | X | " |
| 56 | 40 | 0.5 | Q: 880° C., T: 580° C. | 795 | 942 | 18 | 62 | 79 | 0.52 | 294 | Δ | " |
| 56 | 200 | 0.02 | Q: 880° C., T: 580° C. | 632 | 803 | 20 | 64 | 82 | 0.51 | 494 | Δ | " |
| 56 | 400 | 0.002 | Q: 880° C., T: 580° C. | 593 | 763 | 21 | 65 | 94 | 0.51 | 551 | Δ | " |
| 57 | 40 | 0.5 | Q: 880° C., T: 580° C. | 863 | 1042 | 17 | 60 | 88 | 0.52 | 150 | Δ | " |
| 57 | 200 | 0.02 | Q: 880° C., T: 580° C. | 806 | 983 | 19 | 62 | 96 | 0.51 | 234 | Δ | " |
| 57 | 400 | 0.01 | Q: 880° C., T: 580° C. | 762 | 932 | 21 | 62 | 102 | 0.51 | 308 | Δ | " |
| 58 | 40 | 0.5 | Q: 880° C., T: 580° C. | 862 | 1032 | 15 | 51 | 65 | 0.29 | 863 | Δ | " |
| 58 | 200 | 0.02 | Q: 880° C., T: 580° C. | 802 | 979 | 17 | 58 | 74 | 0.28 | 821 | Δ | " |
| 58 | 400 | 0.01 | Q: 880° C., T: 580° C. | 728 | 928 | 17 | 59 | 81 | 0.30 | 915 | Δ | |

Comparative steel 54 had a good balance between strength and toughness at any cooling rate as compared with comparative steel 55, but was inferior in all the properties to the conventional heat-treated steels 56 and 57 and the steels of this invention. It is, thus, obvious that the conventional non heat-treated steels 54 and 55 are unsuitable for a large part having a low cooling rate, though they may be used for a small part having a relatively high cooling rate.

On the other hand, the steel of this invention has only a very little dependence of its mechanical properties, or toughness on the cooling rate. Accordingly, it gives better properties than any conventional heat-treated steel to any parts having a different shape, such as a large cross section. More specifically, it uniformly imparts not only high levels of strength, ductility and toughness, but also good machinability and property of forming good chips.

EXAMPLE 2

Blooms were prepared by continuous casting from steels having different compositions as selected from those shown in Tables 2 to 5. The blooms were heated to 1150° C., and hot rolled into bars having a diameter of 200 mm. The bars were heated to 1200° C., hot forged into bars having a diameter of 30 mm, and cooled, from 800° C. to 500° C. at a cooling rate of 0.05° C./s to 5° C./s. Some of the bars were heat treated by holding at 550° C. for 40 minutes. Steels 56 and 57 were heated at 900° C. for an hour after rolling, quenched in oil having a temperature of 60° C., and tempered at 570° C. for an hour.

The steel bars were, then, tested for mechanical properties. The results are shown in Table 8. The tensile and impact tests were conducted under the same conditions as in Example 1. A drilling test was conducted for determining as a measure of machinability the total depth of holes made by a drill before it broke. The test was conducted by employing a high-speed steel drill having a diameter of 5 mm at a rotating speed of 2000 rpm with 0.15 mm/rev feed to make a hole having a depth of 15 mm. The tests of which the result were shown in FIG. 2 were repeated for the evaluation of chips.

TABLE 8

| Steel | Rate of cooling after hot forging (° C./s) | Reheating | YS (MPa) | TS (MPa) | El (%) | RA (%) | $uE_{20}$ ($J/cm^2$) | Drill life (mn) | Nature of chips | Remarks |
|---|---|---|---|---|---|---|---|---|---|---|
| 1 | 0.05 | — | 747 | 926 | 26 | 72 | 146 | 6203 | ⊙ | Invention |
| 1 | 0.5 | — | 742 | 930 | 26 | 72 | 144 | 6180 | ⊙ | " |
| 1 | 0.5 | 550° C., 40 min | 771 | 962 | 23 | 67 | 133 | 5974 | ⊙ | " |
| 1 | 5 | — | 746 | 934 | 25 | 70 | 143 | 6153 | ⊙ | " |
| 15 | 0.05 | — | 752 | 953 | 24 | 68 | 136 | 9530 | ⊙ | Invention |
| 15 | 0.5 | — | 756 | 960 | 23 | 67 | 134 | 9600 | ⊙ | " |
| 15 | 5 | — | 749 | 958 | 23 | 67 | 134 | 9580 | ⊙ | " |
| 15 | 5 | 550° C., 40 min | 782 | 991 | 21 | 63 | 122 | 9910 | ⊙ | " |
| 16 | 0.1 | — | 749 | 941 | 24 | 68 | 140 | 7131 | ⊙ | " |
| 16 | 0.5 | — | 752 | 944 | 23 | 67 | 139 | 7108 | ⊙ | " |
| 16 | 5 | — | 744 | 936 | 23 | 67 | 142 | 7169 | ⊙ | " |
| 18 | 0.05 | — | 731 | 942 | 23 | 67 | 140 | 6665 | ⊙ | Invention |
| 18 | 0.05 | 550° C., 40 min | 782 | 986 | 20 | 62 | 124 | 6367 | ⊙ | " |
| 18 | 0.5 | — | 728 | 938 | 24 | 68 | 142 | 6693 | ⊙ | " |
| 18 | 5 | — | 727 | 936 | 24 | 68 | 142 | 6707 | ⊙ | " |
| 22 | 0.05 | — | 768 | 938 | 23 | 67 | 142 | 7541 | ⊙ | " |
| 22 | 0.5 | — | 771 | 941 | 24 | 68 | 140 | 7517 | ⊙ | " |
| 22 | 5 | — | 765 | 932 | 24 | 68 | 144 | 7590 | ⊙ | " |
| 23 | 0.05 | — | 794 | 938 | 20 | 62 | 123 | 6791 | ⊙ | " |
| 23 | 0.5 | — | 788 | 983 | 21 | 63 | 125 | 6826 | ⊙ | " |
| 23 | 5 | — | 785 | 977 | 22 | 65 | 127 | 6868 | ⊙ | " |
| 26 | 0.05 | — | 732 | 935 | 25 | 70 | 143 | 8274 | ⊙ | Invention |
| 26 | 0.5 | — | 735 | 939 | 24 | 68 | 141 | 8239 | ⊙ | " |
| 26 | 5 | — | 729 | 931 | 24 | 68 | 144 | 8309 | ⊙ | " |
| 28 | 0.05 | — | 719 | 908 | 27 | 73 | 152 | 7213 | ⊙ | " |
| 28 | 0.5 | — | 721 | 908 | 26 | 72 | 152 | 7213 | ⊙ | " |
| 28 | 5 | — | 715 | 904 | 26 | 72 | 154 | 7244 | ⊙ | " |
| 30 | 0.05 | — | 748 | 906 | 26 | 72 | 153 | 7112 | ⊙ | Invention |
| 30 | 0.5 | — | 744 | 901 | 27 | 73 | 155 | 7151 | ⊙ | " |
| 30 | 5 | — | 746 | 904 | 26 | 72 | 154 | 7127 | ⊙ | " |
| 38 | 0.05 | — | 701 | 902 | 28 | 75 | 155 | 6782 | ⊙ | " |
| 38 | 0.5 | — | 704 | 910 | 26 | 72 | 152 | 6722 | ⊙ | " |
| 38 | 5 | — | 699 | 901 | 27 | 73 | 155 | 6790 | ⊙ | " |
| 40 | 0.05 | — | 745 | 945 | 22 | 65 | 139 | 6243 | ⊙ | " |
| 40 | 0.5 | — | 747 | 948 | 23 | 67 | 138 | 6223 | ⊙ | " |
| 40 | 5 | — | 742 | 942 | 24 | 68 | 140 | 6263 | ⊙ | " |
| 54 | 0.05 | — | 552 | 802 | 20 | 59 | 62 | 540 | X | Comparative |
| 54 | 0.5 | — | 569 | 840 | 19 | 58 | 66 | 480 | X | " |
| 54 | 5 | — | 601 | 883 | 21 | 60 | 66 | 588 | X | " |
| 55 | 0.05 | — | 505 | 713 | 21 | 59 | 30 | 624 | X | " |
| 55 | 0.5 | — | 531 | 742 | 21 | 61 | 37 | 660 | X | " |
| 55 | 5 | — | 551 | 766 | 23 | 64 | 40 | 672 | X | " |
| 56 | 0.05 | Q: 900° C., T: 570° C. | 795 | 942 | 18 | 62 | 79 | 300 | Δ | Comparative |
| 56 | 0.5 | Q: 900° C., T: 570° C. | 802 | 944 | 19 | 64 | 82 | 261 | Δ | " |
| 56 | 5 | Q: 900° C., T: 570° C. | 798 | 948 | 18 | 65 | 94 | 228 | Δ | " |
| 57 | 0.05 | Q: 900° C., T: 570° C. | 863 | 1042 | 17 | 60 | 62 | 114 | Δ | " |
| 57 | 0.5 | Q: 900° C., T: 570° C. | 871 | 1033 | 19 | 62 | 68 | 108 | Δ | " |
| 57 | 5 | Q: 900° C., T: 570° C. | 869 | 1038 | 17 | 62 | 73 | 180 | Δ | " |

As is obvious from Table 8, the steels according to this invention showed a high strength, TS, of at least 832 MPa irrespective of the rate of cooling after hot forging. They also showed a satisfactorily high ductility as confirmed by an El value of at least 21% and an RA value of at least 62%, and a very good toughness of at least 122 $J/cm^2$. They also showed a very good drill machinability as compared with the conventional non heat-treated steels 54 and 55.

On the other hand, the conventional non heat-treated steel 55 showed a great dependence of its strength, ductility and toughness on the cooling rate, as had been the case with the steel as hot rolled. Steel 55 having a ferrite-pearlite structure showed a TS as low as 766 MPa even at a high cooling rate and a still lower TS at a low cooling rate. Its toughness was only about 40 $J/cm^2$ even at a high cooling rate and only about 30 $J/cm^2$ at a low cooling rate.

Comparative steel 54 had a good balance between strength and toughness at any cooling rate as compared with comparative steel 55, but was inferior in all the properties to the conventional heat-treated steels 56 and 57 and the steels of this invention. It is, thus, obvious that the conventional non heat-treated steels 54 and 55 are unsuitable for a large part having a low cooling rate, though they may be used for a small part having a relatively high cooling rate.

On the other hand, the steel of this invention has only a very little dependence of its mechanical properties, or toughness on the cooling rate, and imparts high levels of strength, ductility and toughness uniformly to any part having a different shape, such as a large cross section.

EXAMPLE 3

Blooms were prepared by continuous casting from steels having different compositions as selected from those shown in Tables 2 to 5. The blooms were heated to 1200° C., and hot rolled into bars having a diameter of 60 mmø. The bars were cold forged by forward extrusion into bars having a diameter of 30 to 50 mmø. The bars were examined for any. internal crack. Some of the bars were heat treated by holding at 550° C. for 40 minutes.

Tensile testpieces (JIS #4) and impact testpieces (JIS#3) were taken from the steel bars, and tested for mechanical properties. The results are shown in Tables 9 and 10. A drilling test was conducted for determining as a measure of machinability the total depth of holes made by a drill before it broke. The test was conducted by employing a high-speed steel drill having a diameter of 4 mmø at a rotating speed of 1500 rpm with 0.10 mm/rev feed to make a hole having a depth of 12 mm. The tests of which the result were shown in FIG. 2 were repeated for the evaluation of chips.

TABLE 9

| Steel | Diameter as rolled (mmϕ) | Diameter as forged (mmϕ) | Work ratio (%) | Crack percentage (%) | Heat treatment: Hardening | Heat treatment: Tempering | YS (MPa) | TS (MPa) | EI (%) | RA (%) | $uE_{20}$ (J/cm$^2$) | Drill life (mm) | Nature of chips | Remarks |
|---|---|---|---|---|---|---|---|---|---|---|---|---|---|---|
| 1 | 60 | 50 | 31 | 0 | — | — | 767 | 1065 | 21 | 60 | 165 | 100 | ◎ | Invention |
| | 60 | 40 | 56 | 0 | — | — | 863 | 1182 | 18 | 52 | 123 | 4594 | ◎ | " |
| | 60 | 30 | 75 | 0 | — | — | 928 | 1289 | 16 | 47 | 114 | 4215 | ◎ | " |
| | 60 | 30 | 75 | 0 | — | Hold at 550° C. for 40 min. | 809 | 1108 | 28 | 71 | 180 | 4901 | ◎ | " |
| 15 | 60 | 50 | 31 | 0 | — | — | 783 | 1058 | 21 | 60 | 168 | 9967 | ◎ | Invention |
| | 60 | 40 | 56 | 0 | — | — | 876 | 1217 | 17 | 51 | 110 | 11462 | ◎ | " |
| | 60 | 30 | 75 | 0 | — | — | 944 | 1312 | 16 | 47 | 106 | 12359 | ◎ | " |
| | 60 | 30 | 75 | 0 | — | Hold at 550° C. for 40 min. | 843 | 1154 | 27 | 69 | 163 | 10876 | ◎ | " |
| 16 | 60 | 50 | 31 | 0 | — | — | 787 | 1063 | 21 | 60 | 166 | 8135 | ◎ | Invention |
| | 60 | 40 | 56 | 0 | — | — | 867 | 1212 | 17 | 51 | 112 | 9274 | ◎ | " |
| | 60 | 30 | 75 | 0 | — | — | 941 | 1297 | 16 | 47 | 111 | 9925 | ◎ | " |
| | 60 | 30 | 75 | 0 | — | Hold at 550° C. for 40 min. | 810 | 1129 | 28 | 71 | 172 | 8635 | ◎ | " |
| 18 | 60 | 50 | 31 | 0 | — | — | 766 | 1055 | 22 | 62 | 169 | 6239 | ◎ | Invention |
| | 60 | 40 | 56 | 0 | — | — | 860 | 1192 | 18 | 52 | 119 | 5521 | ◎ | " |
| | 60 | 30 | 75 | 0 | — | — | 961 | 1329 | 16 | 47 | 126 | 4951 | ◎ | " |
| | 60 | 30 | 75 | 0 | — | Hold at 550° C. for 40 min. | 851 | 1183 | 26 | 68 | 152 | 5563 | ◎ | " |
| 22 | 60 | 50 | 31 | 0 | — | — | 765 | 1069 | 22 | 62 | 164 | 6489 | ◎ | Invention |
| | 60 | 40 | 56 | 0 | — | — | 878 | 1230 | 17 | 51 | 118 | 5643 | ◎ | " |
| | 60 | 30 | 75 | 0 | — | — | 964 | 1337 | 15 | 45 | 102 | 5191 | ◎ | " |
| | 60 | 30 | 75 | 0 | — | Hold at 550° C. for 40 min. | 849 | 1163 | 26 | 68 | 160 | 5967 | ◎ | " |
| 23 | 60 | 50 | 31 | 0 | — | — | 794 | 1097 | 21 | 60 | 154 | 5852 | ◎ | Invention |
| | 60 | 40 | 56 | 0 | — | — | 918 | 1272 | 16 | 49 | 118 | 5045 | ◎ | " |
| | 60 | 30 | 75 | 0 | — | — | 987 | 1349 | 15 | 45 | 109 | 4758 | ◎ | " |
| | 60 | 30 | 75 | 0 | — | Hold at 550° C. for 40 min. | 829 | 1147 | 25 | 66 | 166 | 5598 | ◎ | " |
| 26 | 60 | 50 | 31 | 0 | — | — | 799 | 1103 | 22 | 62 | 151 | 6971 | ◎ | Invention |
| | 60 | 40 | 56 | 0 | — | — | 921 | 1269 | 15 | 47 | 121 | 6062 | ◎ | " |
| | 60 | 30 | 75 | 0 | — | — | 988 | 1357 | 14 | 44 | 111 | 5668 | ◎ | " |
| | 60 | 30 | 75 | 0 | — | Hold at 550° C. for 40 min. | 853 | 1167 | 24 | 64 | 158 | 6590 | ◎ | " |

TABLE 10

| Steel | Diameter as rolled (mmϕ) | Diameter as forged (mmϕ) | Work ratio (%) | Crack percentage (%) | Heat treatment: Hardening | Heat treatment: Tempering |
|---|---|---|---|---|---|---|
| 28 | 60 | 50 | 31 | 0 | — | — |
| | 60 | 40 | 56 | 0 | — | — |
| | 60 | 30 | 75 | 0 | — | — |
| | 60 | 30 | 75 | 0 | — | Hold at 550° C. for 40 min. |
| 30 | 60 | 50 | 31 | 0 | — | — |
| | 60 | 40 | 56 | 0 | — | — |
| | 60 | 30 | 75 | 0 | — | — |
| | 60 | 30 | 75 | 0 | — | Hoid at 550° C. for 40 min. |
| 38 | 60 | 50 | 31 | 0 | — | — |
| | 60 | 40 | 56 | 0 | — | — |
| | 60 | 30 | 75 | 0 | — | — |
| | 60 | 30 | 75 | 0 | — | Hold at 550° C. for 40 min. |
| 40 | 60 | 50 | 31 | 0 | — | — |
| | 60 | 40 | 56 | 0 | — | — |
| | 60 | 30 | 75 | 0 | — | — |
| | 60 | 30 | 75 | 0 | — | Hold at 550° C. for 40 min. |

TABLE 10-continued

| | | | | | | |
|---|---|---|---|---|---|---|
| 57 | 60 | 50 | 31 | 25 | — | — |
| | 60 | 40 | 56 | 35 | — | — |
| | 60 | 30 | 75 | 70 | — | — |
| | 60 | 30 | 75 | 70 | 865° C. × 30 min | 660° C. × 1 h |

| Steel | YS (MPa) | TS (MPa) | EI (%) | RA (%) | $uE_{20}$ ($J/cm^2$) | Drill life (mn) | Nature of chips | Remarks |
|---|---|---|---|---|---|---|---|---|
| 28 | 765 | 1044 | 25 | 67 | 173 | 6051 | ⊙ | Invention |
| | 859 | 1190 | 22 | 59 | 120 | 5308 | ⊙ | " |
| | 932 | 1284 | 21 | 55 | 115 | 4920 | ⊙ | " |
| | 818 | 1117 | 26 | 68 | 176 | 5655 | ⊙ | " |
| 30 | 799 | 1087 | 25 | 67 | 157 | 5926 | ⊙ | Invention |
| | 916 | 1261 | 23 | 61 | 118 | 5109 | ⊙ | " |
| | 976 | 1348 | 21 | 55 | 107 | 4779 | ⊙ | " |
| | 838 | 1146 | 26 | 68 | 166 | 5623 | ⊙ | " |
| 38 | 762 | 1046 | 22 | 62 | 172 | 5901 | ⊙ | Invention |
| | 868 | 1203 | 19 | 54 | 115 | 5135 | ⊙ | " |
| | 961 | i329 | 17 | 49 | 106 | 4646 | ⊙ | " |
| | 835 | 1143 | 24 | 64 | 167 | 5403 | ⊙ | " |
| 40 | 815 | 1125 | 20 | 59 | 144 | 4989 | ⊙ | Invention |
| | 930 | 1276 | 17 | 51 | 114 | 4396 | ⊙ | " |
| | 993 | 1372 | 15 | 45 | 101 | 4089 | ⊙ | " |
| | 842 | 1152 | 22 | 61 | 164 | 4868 | ⊙ | " |
| 57 | 669 | 1049 | 12 | 27 | 28 | 98 | Δ | Comparative |
| | 741 | 1163 | 11 | 24 | 25 | 39 | Δ | " |
| | 798 | 1251 | 10 | 23 | 23 | 12 | Δ | " |
| | 834 | 980 | 12 | 40 | 59 | 87 | Δ | " |

The conventional heat-treated steel 57 was heated at 865° C. for an hour after cold forging, quenched in oil having a temperature of 60° C., tempered at 600° C. for an hour, and tested for mechanical properties. The test results are shown in Table 10. In Tables 9 and 10, steels 1 to 40 are of this invention, and steel 57 in Table 10 is a machine structural alloy steel as specified by JIS.

As is obvious from Tables 9 and 10, the steels of this invention did not crack as a result of cold forging as opposed to comparative steel 57, but were also good in machinability and the nature of chips. It is, thus, obvious that the steel of this invention is suitable for cold forging, too.

Moreover, the steel of this invention has its impact strength improved by heat treatment after cold forging without having any substantial lowering of its tensile strength. Therefore, its heat treatment is desirable after cold working if it is intended for use in a field in which its toughness is of importance.

Industrial Utility

The non heat-treated steels of this invention have microstructures that consist essentially of granular bainitic ferrite. The microstructures can also contain bainitic ferrite or quasi-poligonal ferrite along with the granular bainitic ferrite. However, in the steels that contain bainitic ferrite or quasi-poligonal ferrite, neither of these phases affects the basic and novel characteristics of the steels.

As is obvious from the foregoing, the steel of this invention exhibits a high strength, TS, of at least 827 MPa and a high toughness, $uE_{20}$, of at least 101 $J/cm^2$, as well as good machinability, in its as-hot or cold worked state without calling for any heat treatment after rolling or working as a rule, and without calling for any control of the rate of cooling after rolling or hot working. The non heat-treated steel of this invention, thus, exibits a good balance between strength and toughness even when used for making a larger part than what can be made from any conventional non heat-treated steel, and it can, therefore, be used for a wide range of machine structural parts of which high levels of strength and toughness are required, such as important safety parts for automobiles, shafts, spring parts, and rolling or sliding parts.

What is claimed is:

1. A non heat-treated steel comprising less than 0.05 wt % C, 0.005 to 2.0 wt % Si, more than 0.5 to 5.0 wt % Mn, 0.1 to 10.0 wt % Ni, more than 1.0 to 4.0 wt % Cu, 0.0002 to 1.0 wt % Al, 0.005 to 0.5 wt % S, and 0.0010 to 0.0200 wt % N, the steel having a tensile strength of at least about 827 MPa and a toughness of at least about 101 $J/cm^2$.

2. A non heat-treated steel as set forth in claim 1, further comprising one or more of not more than 0.5 wt % W, not more than 0.5 wt % V and not more than 0.1 wt % Ti.

3. A non heat-treated steel as set forth in claim 1, further comprising one or more of not more than 3.0 wt % Cr, not more than 1.0 wt % Mo, not more than 0.15 wt % Nb and not more than 0.03 wt % B.

4. A non heat-treated steel as set forth in claim 1, further comprising one or more of not more than 0.1 wt % Zr, not more than 0.02 wt % Mg, not more than 0.1 wt % Hf and not more than 0.02 wt % REM.

5. A non heat-treated steel as set forth in claim 1, further comprising one or more of not more than 3.0 wt % Cr, not more than 1.0 wt % Mo, not more than 0.15 wt % Nb and not more than 0.03 wt % B, and one or more of not more than 0.1 wt % Zr, not more than 0.02 wt % Mg, not more than 0.1 wt % Hf and not more than 0.02 wt % REM.

6. A non heat-treated steel as set forth in claim 1, further comprising one or more of not more than 0.10 wt % P, not more than 0.30 wt % Pb, not more than 0.10 wt % Co, not more than 0.02 wt % Ca, not more than 0.05 wt % Te, not more than 0.10 wt % Se, not more than 0.05 wt % Sb and not more than 0.30 wt % Bi.

7. A non heat-treated steel as set forth in claim 1, further comprising one or more of not more than 3.0 wt % Cr, not more than 1.0 wt % Mo, not more than 0.15 wt % Nb and not more than 0.03 wt % B, and one or more of not more than 0.10 wt % P, not more than 0.30 wt % Pb, not more than 0.10 wt % Co, not more than 0.02 wt % Ca, not more than 0.05 wt % Te, not more than 0.10 wt % Se, not more than 0.05 wt % Sb and not more than 0.30 wt % Bi.

8. A non heat-treated steel as set forth in claim 1, further comprising one or more of not more than 0.1 wt % Zr, not more than 0.02 wt % Mg, not more than 0.1 wt % Hf and not more than 0.02 wt % REM, and one or more of not more than 0.10 wt % P, not more than 0.30 wt % Pb, not more than 0.10 wt % Co, not more than 0.02 wt % Ca, not more than 0.05 wt % Te, not more than 0.10 wt % Se, not more than 0.05 wt % Sb and not more than 0.30 wt % Bi.

9. A non heat-treated steel as set forth in claim 1, further comprising one or more of not more than 3.0 wt % Cr, not more than 1.0 wt % Mo, not more than 0.15 wt % Nb and not more than 0.03 wt % B, one or more of not more than 0.1 wt % Zr, not more than 0.02 wt % Mg, not more than 0.1 wt % Hf and not more than 0.02 wt % REM, and one or more of not more than 0.10 wt % P, not more than 0.30 wt % Pb, not more than 0.10 wt % Co, not more than 0.02 wt % Ca, not more than 0.05 wt % Te, not more than 0.10 wt % Se, not more than 0.05 wt % Sb and not more than 0.30 wt % Bi.

10. A non heat-treated steel as set forth in claim 1, wherein the steel comprises at least about 1 wt % of Mn.

11. A non heat-treated steel as set forth in claim 1, wherein the steel comprises at least about 2 wt % of Mn.

12. A non heat-treated steel as set forth in claim 1, wherein the steel has a tensile strength of at least about 900 MPa and a toughness of at least about 101 J/cm$^2$.

13. A non heat-treated steel as set forth in claim 1, wherein the steel has a tensile strength of at least about 1000 MPa and a toughness of at least about 101 J/cm$^2$.

14. A non heat-treated steel as set forth in claim 1, wherein the steel has a tensile strength of at least about 1300 MPa and a toughness of at least about 101 J/cm$^2$.

15. A non heat-treated steel, comprising less than 0.05 wt % C, 0.005 to 2.0 wt % Si, 0.5 to 5.0 wt % Mn, 0.1 to 10.0 wt % Ni, more than 1.0 to 4.0 wt % Cu, 0.0002 to 1.0 wt % Al, 0.005 to 0.5 wt % S, and 0.0010 to 0.0200 wt % N, and the steel having a tensile strength of at least about 1000 MPa.

16. A non heat-treated steel as set forth in claim 15, wherein the steel has a toughness of at least about 101 J/cm$^2$.

17. A non heat-treated steel as set forth in claim 15, wherein the steel has a tensile strength of at least about 1200 MPa.

18. A non heat-treated steel as set forth in claim 15, wherein the steel comprises at least about 1 wt % of Mn.

19. A non heat-treated steel as set forth in claim 15, wherein the steel comprises at least about 2 wt % of Mn.

20. A non heat-treated steel, comprising less than 0.05 wt % C, 0.005 to 2.0 wt % Si, more than 0.5 to 5.0 wt % Mn, 0.1 to 10.0 wt % Ni, more than 1.0 to 4.0 wt % Cu, 0.0002 to 1.0 wt % Al, 0.005 to 0.5 wt % S, and 0.0010 to 0.0200 wt % N, and the steel having a microstructure that consists essentially of granular bainitic ferrite.

21. A non heat-treated steel as set forth in claim 20, wherein the microstructure of the steel further contains bainitic ferrite.

22. A non heat-treated steel as set forth in claim 20, wherein the microstructure of the steel further contains quasi-poligonal ferrite.

23. A non heat-treated steel as set forth in claim 20, wherein the steel comprises at least about 1 wt % of Mn.

24. A non heat-treated steel as set forth in claim 20, wherein the steel comprises at least about 2 wt % of Mn.

25. A non heat-treated steel as set forth in claim 20, wherein the steel has a tensile strength of at least about 827 MPa and a toughness of at least about 101 J/cm$^2$.

26. A non heat-treated steel as set forth in claim 20, wherein the steel has a tensile strength of at least about 900 MPa and a toughness of at least about 101 J/cm$^2$.

27. A non heat-treated steel as set forth in claim 20, wherein the steel has a tensile strength of at least about 1000 MPa and a toughness of at least about 101 J/cm$^2$.

28. A non heat-treated steel as set forth in claim 20, wherein the steel has a tensile strength of at least about 1300 MPa and a toughness of at least about 101 J/cm$^2$.

29. A non heat-treated steel comprising less than 0.05 wt % C, 0.005 to 2.0 wt % Si, 0.5 to 5.0 wt % Mn, 0.1 to 10.0 wt % Ni, more than 1.0 to 4.0 wt % Cu, 0.0002 to 1.0 wt % Al, 0.005 to 0.5 wt % S, and 0.0010 to 0.0200 wt % N, the steel having a fatigue limit ratio of at least 0.51.

* * * * *